US011079176B2

(12) United States Patent
Pierre, Jr.

(10) Patent No.: US 11,079,176 B2
(45) Date of Patent: Aug. 3, 2021

(54) METHOD AND SYSTEM FOR LIQUEFACTION OF NATURAL GAS USING LIQUID NITROGEN

(71) Applicant: Fritz Pierre, Jr., Humble, TX (US)

(72) Inventor: Fritz Pierre, Jr., Humble, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 267 days.

(21) Appl. No.: 16/262,243

(22) Filed: Jan. 30, 2019

(65) Prior Publication Data

US 2019/0285340 A1 Sep. 19, 2019

Related U.S. Application Data

(60) Provisional application No. 62/642,961, filed on Mar. 14, 2018.

(51) Int. Cl.

| | |
|---|---|
| ***F25J 1/02*** | (2006.01) |
| ***F25J 3/02*** | (2006.01) |
| ***F25J 1/00*** | (2006.01) |

(52) U.S. Cl.

CPC ..... *F25J 3/0257* (2013.01); *F25J 1/004* (2013.01); *F25J 1/005* (2013.01); *F25J 1/0022* (2013.01); *F25J 1/0221* (2013.01); *F25J 1/0223* (2013.01); *F25J 1/0278* (2013.01); *F25J 3/0209* (2013.01); *F25J 3/0233* (2013.01); *F25J 2200/02* (2013.01); *F25J 2200/40* (2013.01); *F25J 2205/02* (2013.01); *F25J 2205/04* (2013.01); *F25J 2205/30* (2013.01); *F25J 2205/90* (2013.01); *F25J 2210/42* (2013.01); *F25J 2210/90* (2013.01); *F25J 2215/04* (2013.01); *F25J 2220/62* (2013.01);

(Continued)

(58) Field of Classification Search

CPC ..... F25J 3/0209; F25J 3/0022; F25J 3/004; F25J 3/0221; F25J 3/0223; F25J 2200/02; F25J 2210/42; F25J 2215/60; F25J 2270/42; F25J 2270/904; F25J 2240/68

See application file for complete search history.

(56) References Cited

U.S. PATENT DOCUMENTS

| | | | |
|---|---|---|---|
| 3,747,359 | A | 7/1973 | Streich |
| 3,878,689 | A | 4/1975 | Grenci |

(Continued)

FOREIGN PATENT DOCUMENTS

| | | |
|---|---|---|
| DE | 102013007208 | 10/2014 |

*Primary Examiner* — Brian M King

(74) *Attorney, Agent, or Firm* — ExxonMobil Upstream Research Company—Law Department

(57) ABSTRACT

A method for producing liquefied natural gas (LNG) from a natural gas stream having a nitrogen concentration of greater than 1 mol %. At least one liquid nitrogen (LIN) stream is received at an LNG liquefaction facility. The LIN streams may be produced at a different geographic location from the LNG liquefaction facility. A natural gas stream is liquefied by indirect heat exchange with a nitrogen vent stream to form a pressurized LNG stream. The pressurized LNG stream has a nitrogen concentration of greater than 1 mol %. The pressurized LNG stream is directed to one or more stages of a column to produce an LNG stream and the nitrogen vent stream. The column has upper stages and lower stages. The LIN streams are directed to one or more upper stages of the column.

7 Claims, 8 Drawing Sheets

(52) U.S. Cl.
CPC ..... *F25J 2240/60* (2013.01); *F25J 2245/90* (2013.01); *F25J 2270/08* (2013.01); *F25J 2270/16* (2013.01); *F25J 2270/904* (2013.01); *F25J 2290/62* (2013.01)

(56) References Cited

U.S. PATENT DOCUMENTS

| | | | | |
|---|---|---|---|---|
| 5,139,547 | A | 8/1992 | Agrawal et al. | |
| 6,214,258 | B1 | 4/2001 | Woodward et al. | |
| 2004/0050095 | A1* | 3/2004 | Brigham | F25J 3/04254 62/643 |
| 2004/0182109 | A1* | 9/2004 | Oakey | F25J 3/0257 62/620 |
| 2008/0256977 | A1 | 10/2008 | Mowrey et al. | |
| 2011/0289963 | A1* | 12/2011 | Price | C10L 3/105 62/620 |
| 2012/0198997 | A1 | 8/2012 | Schmidt et al. | |
| 2012/0285196 | A1 | 11/2012 | Flinn et al. | |
| 2014/0345319 | A1* | 11/2014 | Corte Real Santos | F25J 1/0237 62/618 |
| 2015/0121953 | A1* | 5/2015 | Bauer | F25J 1/0052 62/619 |
| 2017/0016667 | A1* | 1/2017 | Huntington | F25J 1/0042 |

* cited by examiner

METHOD AND SYSTEM FOR LIQUEFACTION OF NATURAL GAS USING LIQUID NITROGEN

CROSS REFERENCE TO RELATED APPLICATIONS

This application claims the priority benefit of U.S. Patent Application No. 62/642,961 filed Mar. 14, 2018 entitled METHOD AND SYSTEM FOR LIQUEFACTION OF NATURAL GAS USING LIQUID NITROGEN, the entirety of which is incorporated by reference herein.

BACKGROUND

Field of Disclosure

The disclosure relates generally to the field of natural gas liquefaction to form liquefied natural gas (LNG). More specifically, the disclosure relates to the liquefaction of natural gas comprising a nitrogen concentration greater than 1 mol % by using liquid nitrogen.

Description of Related Art

This section is intended to introduce various aspects of the art, which may be associated with the present disclosure. This discussion is intended to provide a framework to facilitate a better understanding of particular aspects of the present disclosure. Accordingly, it should be understood that this section should be read in this light, and not necessarily as an admission of prior art.

LNG is a rapidly growing means to supply natural gas from locations with an abundant supply of natural gas to distant locations with a strong demand for natural gas. The conventional LNG cycle includes: a) initial treatments of the natural gas resource to remove contaminants such as water, sulfur compounds and carbon dioxide; b) the separation of some heavier hydrocarbon gases, such as propane, butane, pentane, etc. by a variety of possible methods including self-refrigeration, external refrigeration, lean oil, etc.; c) refrigeration of the natural gas substantially by external refrigeration to form liquefied natural gas at or near atmospheric pressure and about −160° C.; d) removal of light components from the LNG such as nitrogen and helium; e) transport of the LNG product in ships or tankers designed for this purpose to a market location; and f) re-pressurization and regasification of the LNG at a regasification plant to form a pressurized natural gas stream that may be distributed to natural gas consumers. Step c) of the conventional LNG cycle usually requires the use of large refrigeration compressors often powered by large gas turbine drivers that emit substantial carbon and other emissions. Large capital investments in the billions of US dollars and extensive infrastructure are required as part of the liquefaction plant. Step f) of the conventional LNG cycle generally includes re-pressurizing the LNG to the required pressure using cryogenic pumps and then re-gasifying the LNG to form pressurized natural gas by exchanging heat through an intermediate fluid but ultimately with seawater or by combusting a portion of the natural gas to heat and vaporize the LNG. Generally, the available exergy of the cryogenic LNG is not utilized.

A relatively new technology for producing LNG is known as floating LNG (FLNG). FLNG technology involves the construction of the gas treating and liquefaction facility on a floating structure such as barge or a ship. FLNG is a technology solution for monetizing offshore stranded gas where it is not economically viable to construct a gas pipeline to shore. FLNG is also increasingly being considered for onshore and near-shore gas fields located in remote, environmentally sensitive and/or politically challenging regions. The technology has certain advantages over conventional onshore LNG in that it has a lower environmental footprint at the production site. The technology may also deliver projects faster and at a lower cost since the bulk of the LNG facility is constructed in shipyards with lower labor rates and reduced execution risk.

Although FLNG production has several advantages over conventional onshore LNG production, significant technical challenges remain in the application of the FLNG technology. For example, the FLNG structure must provide the same level of gas treating and liquefaction in an area that is often less than a quarter of what would be available for an onshore LNG plant. For this reason, there is a need to develop technology that reduces the footprint of the FLNG plant while maintaining the capacity of the liquefaction facility to reduce overall project cost.

Nitrogen is found in many natural gas reservoirs at concentrations greater than 1 mol %. The liquefaction of natural gas from these reservoirs often necessitates the separation of nitrogen from the produced LNG to reduce the concentration of nitrogen in the LNG to less than 1 mol %. Stored LNG with a nitrogen concentration greater than 1 mol % has a higher risk for auto-stratification and rollover in the storage tanks. This phenomenon leads to rapid vapor release from the LNG in the storage tanks, which is a significant safety concern.

For LNG with a nitrogen concentration less than 2 mol %, sufficient nitrogen separation from the LNG may occur when the pressurized LNG from the hydraulic turbine is expanded by flowing through a valve to a pressure at or close to the LNG storage tank pressure. The resulting two-phase mixture is separated in an end-flash gas separator into a nitrogen rich vapor stream, often referred to as end-flash gas, and an LNG stream with nitrogen concentration less than 1 mol %. The end-flash gas is compressed and incorporated into the fuel gas system of the facility where it can be used to produce process heat, generate electrical power, and/or generate compression power. For LNG with a nitrogen concentration greater than 2 mol %, using a simple end-flash gas separator would require an excessive end-flash gas flow rate to sufficiently reduce the nitrogen concentration in the LNG stream. In such cases, a fractionation column may be used to separate the two-phase mixture into the end-flash gas and the LNG stream. The fractionation column will typically comprise or be incorporated with a reboiler system to produce stripping gas that is directed to bottom stages of the column to reduce the nitrogen level in the LNG stream to less than 1 mol %. In a typical design of this fractionation column with reboiler, the reboiler heat duty is obtained by indirect heat transfer of column's liquid bottom with the pressurized LNG stream before the pressurized LNG stream is expanded in the inlet valves of the fractionation column.

The fractionation column provides a more efficient method for separating nitrogen from the LNG stream compared to a simple end-flash separator. However, the resulting end-flash gas from the column overhead will include a significant concentration of nitrogen. The end-flash gas serves as the primary fuel for the gas turbines in a typical LNG plant. Gas turbines, such as aero derivative gas turbines, may have restrictions on the concentration of nitrogen in the fuel gas of no greater than 10 or 20 mol %. The end-flash gas from the fractionation column overhead may have a nitrogen concentration significantly greater than the concentration limits of a typical aero-derivative gas turbine. For example, a pressurized LNG stream with nitrogen concentration of approximately 4 mol % will produce a column overhead vapor with a nitrogen concentration greater than 30 mol %. End-flash gas with a high nitrogen concentration is often directed to a nitrogen rejection unit (NRU). In the NRU, the nitrogen is separated from the methane to produce a) a nitrogen stream that is sufficiently low in hydrocarbons that it can be vented to the atmosphere and b) a methane-rich stream with a reduced nitrogen concentration to make it suitable for use as a fuel gas. The need for an NRU increases the amount of process equipment and the footprint of the LNG plant, and this increase in equipment and footprint comes at high capital cost for offshore LNG projects and/or in remote area LNG projects.

The need for an NRU may be avoided for certain conditions when the end-flash gas has a high nitrogen concentration. It has been demonstrated that some aero derivative gas turbines may operate using end-flash gas with a high nitrogen concentration if the end-flash gas is compressed to a higher pressure than what is typically required by the gas turbine. For example, it has been shown that a Trent-60 aero derivative gas turbine can operate with a fuel gas comprising up to 40 mol % of nitrogen if its combustion pressure is increased from the typical 50 bar to approximately 70 bar. In this case, a higher pressure fuel gas system provides an alternative approach to the use of an NRU. This alternative approach has the advantage of eliminating all the equipment and added footprint of an NRU. However, it has the disadvantage of increasing the required power for end-flash gas compression and/or fuel gas compression. Additionally, this alternative approach has the disadvantage of not being as flexible to changes in the nitrogen concentration of LNG compared to the flexibility of operation provided by the NRU.

FIG. 1 depicts a conventional end-flash gas system 100 that may be used with an LNG liquefaction system. A pressurized LNG stream 102 from the main LNG cryogenic heat exchanger (not shown) flows through a hydraulic turbine 104 to partially reduce its pressure and further cool the pressurized LNG stream 102. The cooled pressurized LNG stream 106 is then subcooled in a reboiler 108 associated with an LNG fractionation column 110. The liquid bottom stream 112 of the LNG fractionation column 110 is partially vaporized in the reboiler 108 by exchanging heat with the cooled pressurized LNG stream 106. The vapors from the reboiler 108 are separated from the liquid stream and directed back to the LNG fractionation column 110 as a stripping gas stream 114 that is used to reduce the nitrogen level in the LNG stream 122 to less than 1 mol %. The subcooled pressurized LNG stream 116 is expanded in the inlet valves 118 of the LNG fractionation column to produce a two-phase mixture stream 120 with preferably a vapor fraction of less than 40 mol %, or more preferably less than 20 mol %. The two-phase mixture stream 120 is directed to the upper stages of the LNG fractionation column 110. The separated liquid from the reboiler 108 is an LNG stream 122 with less than 1 mol % nitrogen. The LNG stream 122 is then pumped to storage tanks 124 or other output. The gas in the overhead stream of the LNG fractionation column 110 is referred to as an end-flash gas stream 126. The end-flash gas stream 126 exchanges heat with a treated natural gas stream 128 in a heat exchanger 130 to condense the natural gas and produce an additional pressurized LNG stream 132 that may be mixed with the pressurized LNG stream 102. The warmed end-flash gas stream 134 exits the heat exchanger 130 and is compressed in a compression system 136 to a suitable pressure to be used as fuel gas 138.

The end-flash gas system 100 can produce LNG with a nitrogen concentration of less than 1 mol % while reducing the amount of end-flash gas that is produced. However, for pressurized LNG streams with a nitrogen concentration greater than 3 mol %, the end-flash gas nitrogen concentration may be greater than 20 mol %. The high nitrogen concentration in the end-flash gas may make it less suitable for use as a fuel gas for aero derivative gas turbines. Adding an NRU may be necessary to produce fuel gas of suitable methane concentration for use within the gas turbines.

FIG. 2 shows a system for nitrogen separation from LNG in an end-flash gas system 200, and is similar in structure to the system disclosed in U.S. Patent No. 2012/0285196. Like the end-flash gas system 100, a pressurized LNG stream 202 from the main LNG cryogenic heat exchanger (not shown) flows through a hydraulic turbine 204 to partially reduce its pressure and further cool the pressurized LNG stream 202. The cooled pressurized LNG stream 206 is then subcooled in a reboiler 208 associated with an LNG fractionation column 210. The liquid bottom stream 212 of the LNG fractionation column 210 is partially vaporized in the reboiler 208 by exchanging heat with the cooled pressurized LNG stream 206. The vapors from the column reboiler are separated from the liquid stream and directed back to the LNG fractionation column 210 as a stripping gas stream 214 that is used to reduce the nitrogen level in the LNG stream to less than 1 mol %. The subcooled pressurized LNG stream 216 is expanded in the inlet valves 218 of the LNG fractionation column 210 to produce a two-phase mixture stream 220 with preferably a vapor fraction of less than 40 mol %, or more preferably less 20 mol %. The two-phase mixture stream 220 is directed to the upper stages of the LNG fractionation column 210. The separated liquid from the reboiler 208 is an LNG stream 222 with less than 1 mol % nitrogen. The LNG stream 222 may be directed to a first heat exchanger 224 where it is partially vaporized to provide a portion of the cooling duty for a column reflux stream 226. The partial vaporizing of the LNG stream 222 prior to its storage in an LNG tank 228 significantly increases the requirement of the boil-off gas (BOG) compressor 230. For example, the BOG volumetric flow rate to the BOG compressor 230 may be six times greater than that of a BOG compressor that follows a conventional end-flash gas system. The end-flash gas 232 from the LNG fractionation column 210 is first directed to the first heat exchanger 224 where it is warmed to an intermediate temperature by helping condense the column reflux stream 226. The intermediate temperature end-flash gas stream 234 is then split into a reflux stream 236 and a cold nitrogen vent stream 238. The reflux stream 236 may be compressed in a first reflux compressor 240 and cooled with the environment in a first cooler 242, and may be further compressed in a second reflux compressor 244 and cooled with the environment in a second cooler 246 to provide some of the refrigeration needed to produce the two-phase reflux stream 226 that enters the LNG fractionation column 210. The compressed and environmentally cooled reflux stream 248 is cooled further by indirect heat exchange with the cold nitrogen vent stream 238 in a second heat exchanger 250 to produce a cold reflux stream 252. The cold reflux stream 252 is then condensed and subcooled by indirect heat exchange with the LNG stream 222 and the end-flash gas stream 234 in the first heat exchanger 224. The condensed and subcooled reflux stream 226 is expanded in the inlet valves 254 of the fractionation column 210 to produce a nitrogen-rich two-phase reflux stream 256 that enters the fractionation column 210.

The system shown in FIG. 2 adds a rectification section that enables the end-flash gas stream to have a methane concentration of less than 2 mol %, or more preferably less than 1 mol %, and subsequently allows for the venting of a portion of the end-flash gas to the environment as a nitrogen vent stream 258. The system shown in FIG. 2 produces a nitrogen vent stream and a low-nitrogen fuel gas stream without the addition of separate NRU system. For a pressurized LNG stream with a nitrogen concentration of 5 to 3 mol %, a conventional end-flash gas system will produce an end-flash gas with a nitrogen concentration greater than 20 mol % but less than 40 mol %. It has been shown that this high nitrogen content end-flash gas remains suitable for use in aero derivative gas turbines under the appropriate conditions. However, where a conventional end-flash gas system can still yield suitable fuel gas for burning in a gas turbine, the system shown in FIG. 2 has the disadvantage of requiring one-third more compression power than a conventional end-flash gas system. The system shown in FIG. 2 has the additional disadvantage that LNG production is reduced by approximately 6% when compared to a conventional end-flash gas system.

Known methods for the liquefaction of natural gas comprising a high molar concentration of nitrogen are challenged for offshore and/or remote area LNG projects. For this reason, there is a need to develop a method for liquefying the natural gas and separating nitrogen from the resulting LNG stream, where the method requires significantly less production site process equipment and footprint than previously described methods. There is a further need to develop a liquefaction system that increases LNG production by recondensing one or more low pressure hydrocarbon streams, such as boil off gas from either the LNG storage tanks and/or ship tanks.

SUMMARY

The present disclosure provides a method for liquefying a natural gas stream with a nitrogen concentration of greater than 1 mol %. The natural gas stream is at least partially liquefied by indirect exchange of heat with a cold nitrogen vent stream to form a pressurized LNG stream. At least one liquid nitrogen (LIN) stream is received from storage tanks, the at least one LIN stream being produced at a different geographic location from the LNG facility. The pressurized LNG stream is expanded and then directed to one or more stages of a separation column. The liquid nitrogen stream is directed to the top stage of the separation column. Within the separation column the liquid nitrogen stream directly exchanges heat with the natural gas within the separation column resulting in the formation of an LNG stream as the liquid outlet from the separation column and the cold nitrogen vent stream as the vapor outlet from the separation column. A low pressure natural gas stream, such as boil off gas from either the LNG storage tanks and/or ship tanks, may optionally be directed to the lower stages of the separation column to liquefy the hydrocarbons within said low pressure natural gas stream.

The present disclosure also provides a system for liquefying a natural gas stream with a nitrogen concentration of greater than 1 mol %. A heat exchanger transfers heat from the natural gas stream to a cold nitrogen vent stream to form a pressurized LNG stream. A separation column separates the pressurized LNG stream into an LNG stream and the cold nitrogen vent stream, where the cold nitrogen vent stream has a nitrogen concentration greater than the nitrogen concentration of the pressurized LNG stream and the LNG stream has a nitrogen concentration less than the nitrogen concentration of the pressurized LNG stream. A liquefied nitrogen (LIN) stream, produced at a different geographic location from the LNG liquefaction facility, is directed to the upper stages of the separation column. The separation column may optionally receive a low pressure natural gas stream, such as boil off gas from either the LNG storage tanks and/or ship tanks, to the lower stages of the separation column to liquefy the hydrocarbons within said low pressure natural gas stream.

The foregoing has broadly outlined the features of the present disclosure so that the detailed description that follows may be better understood. Additional features will also be described herein.

BRIEF DESCRIPTION OF THE DRAWINGS

These and other features, aspects and advantages of the disclosure will become apparent from the following description, appending claims and the accompanying drawings, which are briefly described below.

Figure 1:
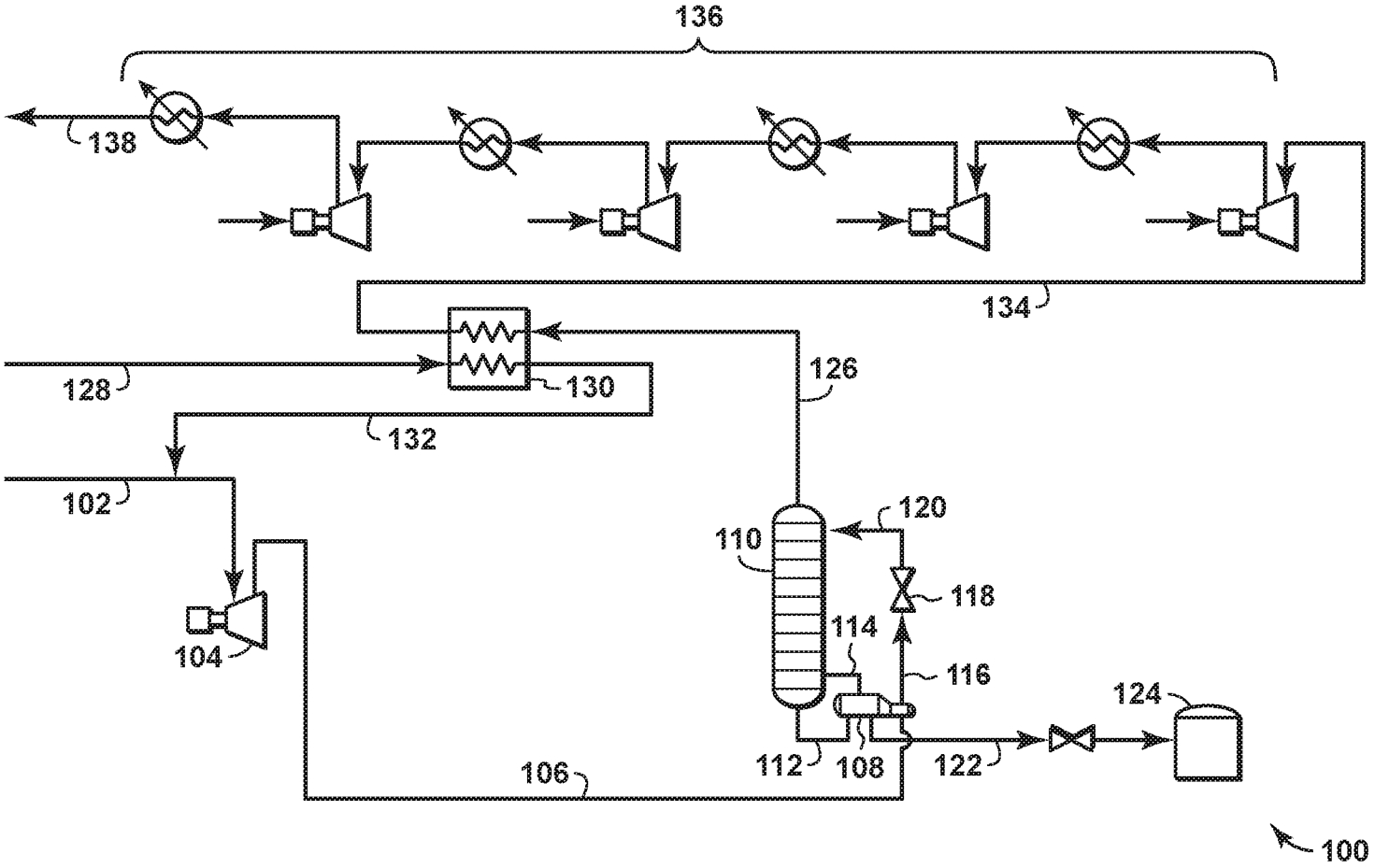
FIG. 1 (Prior Art)
FIG. 1 is a schematic diagram showing a known end-flash gas system.
Figure 2:
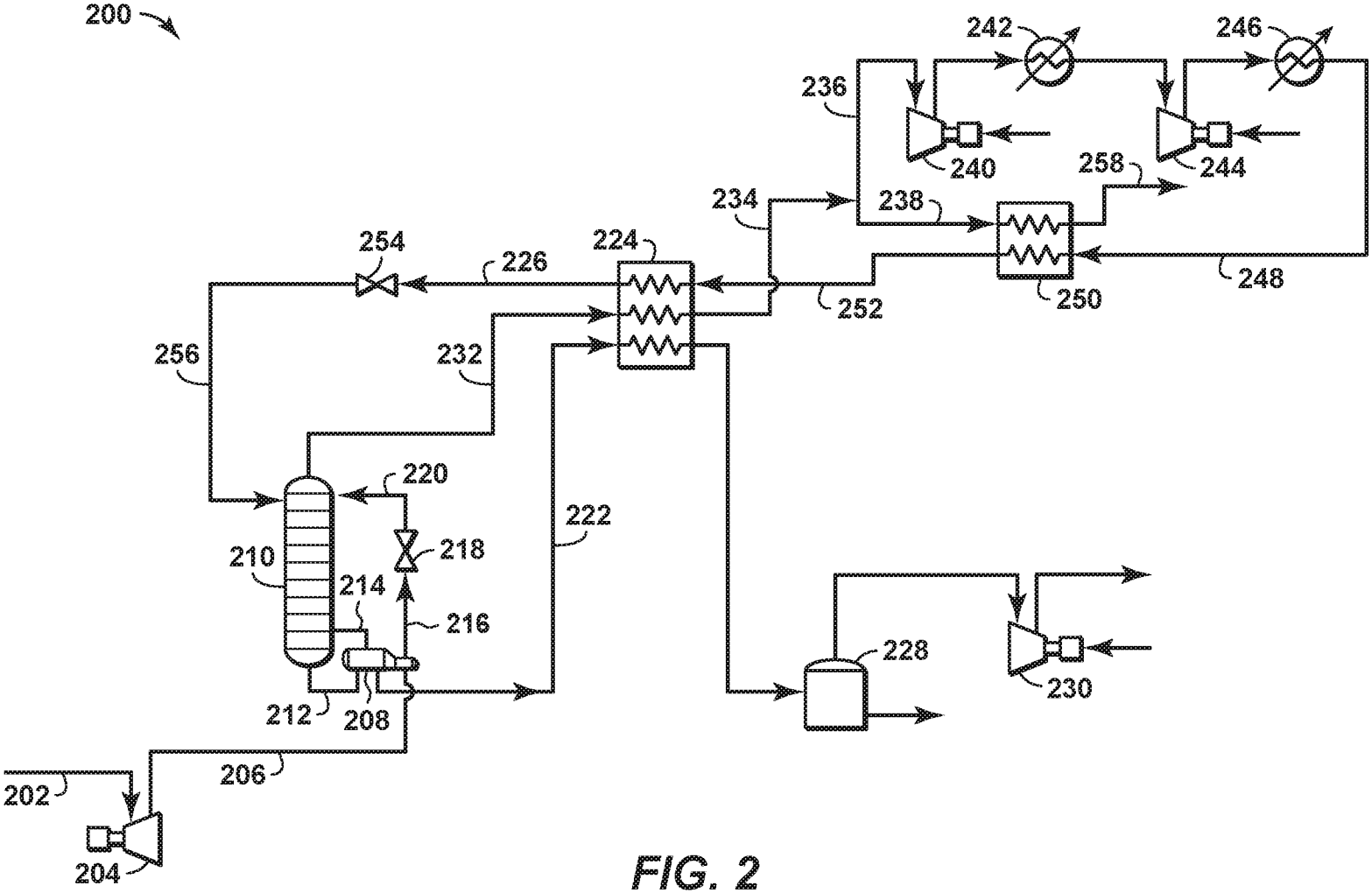
FIG. 2 (Prior Art)
FIG. 2 is a schematic diagram showing another known end-flash as system.

It should be noted that the figures are merely examples and no limitations on the scope of the present disclosure are intended thereby. Further, the figures are generally not drawn to scale, but are drafted for purposes of convenience and clarity in illustrating various aspects of the disclosure.

DETAILED DESCRIPTION

To promote an understanding of the principles of the disclosure, reference will now be made to the features illustrated in the drawings and specific language will be used to describe the same. It will nevertheless be understood that no limitation of the scope of the disclosure is thereby intended. Any alterations and further modifications, and any further applications of the principles of the disclosure as described herein are contemplated as would normally occur to one skilled in the art to which the disclosure relates. For the sake of clarity, some features not relevant to the present disclosure may not be shown in the drawings.

At the outset, for ease of reference, certain terms used in this application and their meanings as used in this context are set forth. To the extent a term used herein is not defined below, it should be given the broadest definition persons in the pertinent art have given that term as reflected in at least one printed publication or issued patent. Further, the present techniques are not limited by the usage of the terms shown below, as all equivalents, synonyms, new developments, and terms or techniques that serve the same or a similar purpose are considered to be within the scope of the present claims.

As one of ordinary skill would appreciate, different persons may refer to the same feature or component by different names. This document does not intend to distinguish between components or features that differ in name only. The figures are not necessarily to scale. Certain features and components herein may be shown exaggerated in scale or in schematic form and some details of conventional elements may not be shown in the interest of clarity and conciseness. When referring to the figures described herein, the same reference numerals may be referenced in multiple figures for the sake of simplicity. In the following description and in the claims, the terms "including" and "comprising" are used in an open-ended fashion, and thus, should be interpreted to mean "including, but not limited to."

The articles "the," "a" and "an" are not necessarily limited to mean only one, but rather are inclusive and open ended so as to include, optionally, multiple such elements.

As used herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numeral ranges provided. Accordingly, these terms should be interpreted as indicating that insubstantial or inconsequential modifications or alterations of the subject matter described and are considered to be within the scope of the disclosure.

The term "heat exchanger" refers to a device designed to efficiently transfer or "exchange" heat from one matter to another. Exemplary heat exchanger types include a co-current or counter-current heat exchanger, an indirect heat exchanger (e.g. spiral wound heat exchanger, plate-fin heat exchanger such as a brazed aluminum plate fin type, shell-and-tube heat exchanger, etc.), direct contact heat exchanger, or some combination of these, and so on.

As previously described, the conventional LNG cycle includes: a) initial treatments of the natural gas resource to remove contaminants such as water, sulfur compounds and carbon dioxide; b) the separation of some heavier hydrocarbon gases, such as propane, butane, pentane, etc. by a variety of possible methods including self-refrigeration, external refrigeration, lean oil, etc.; c) refrigeration of the natural gas substantially by external refrigeration to form liquefied natural gas at or near atmospheric pressure and about −160° C.; d) removal of light components from the LNG such as nitrogen and helium; e) transport of the LNG product in ships or tankers designed for this purpose to a market location; and f) re-pressurization and regasification of the LNG at a regasification plant to form a pressurized natural gas stream that may be distributed to natural gas consumers. Disclosed aspects herein generally involve liquefying natural gas using liquid nitrogen (LIN). In general, using LIN to produce LNG is a non-conventional LNG cycle in which step c) above is replaced by a natural gas liquefaction process that uses a significant amount of LIN as an open loop source of refrigeration, and in which step f) above may be modified to use the exergy of the cryogenic LNG to facilitate the liquefaction of nitrogen gas to form LIN that may then be transported to the resource location and used as a source of refrigeration for the production of LNG. The disclosed LIN-to-LNG concept may further include the transport of LNG in a ship or tanker from the resource location (export terminal) to the market location (import terminal) and the reverse transport of LIN from the market location to the resource location.

The disclosed aspects more specifically describe a method where steps c) and d), described above, are modified to include the use of liquid nitrogen to help liquefy a natural gas and separate nitrogen from the LNG stream. According to disclosed aspects, a method includes receiving liquid nitrogen produced at a location geographically separate from the LNG plant. A natural gas stream having a nitrogen concentration greater than 1 mol % is at least partially liquefied by indirect exchange of heat with a cold nitrogen vent stream to form a pressurized LNG stream and a warm nitrogen vent stream. The warm nitrogen vent stream may be released to the environment or may be directed to other parts of the facility for use. At least one liquid nitrogen (LIN) stream is received from storage tanks, the at least one LIN stream being produced at a different geographic location from the LNG facility. The pressurized LNG stream is expanded in an expansion device and then directed to one or more stages of a separation column. The expansion device may be an expansion valve, a liquid hydraulic turbine, or a combination thereof. The liquid nitrogen stream is directed to the top stage of the separation column. Within the separation column the liquid nitrogen stream directly exchanges heat with the natural gas within the separation column resulting in the formation of an LNG stream as the liquid outlet from the separation column and the cold nitrogen vent stream as the vapor outlet from the separation column. The separation column may be a fractionation column, a distillation column, or an absorption column. The separation column may comprise five or more separation stages. The LNG stream may have a nitrogen molar concentration of less than 2 mol %, or more preferably, a nitrogen molar concentration of less than 1 mol %. The cold nitrogen vent stream may have a methane molar concentration of less than 1 mol %, or more preferably, a methane concentration of less than 0.1 mol %. A low pressure natural gas stream, such as boil off gas from either the LNG storage tanks and/or ship tanks, may optionally be directed to the lower stages of the separation column to liquefy the hydrocarbons within said low pressure natural gas stream.

For a natural gas stream at a pressure of 25 bar with a nitrogen concentration of 5.0 mol %, the liquid nitrogen requirement for this proposed liquefaction system is approximately 2 tons of liquid nitrogen for every ton of LNG produced. For this proposed liquefaction system, approximately 100% of the hydrocarbons are liquefied within the LNG stream. In the case of known liquefaction systems, where the natural gas stream is first liquefied by indirect heat exchange with liquid nitrogen and then followed by a conventional end flash gas system, approximately 20% of the methane is removed with the end flash gas. Thus, the proposed liquefaction system increases LNG production by approximately 20%. This liquefaction system has the additional advantage of significantly reducing the equipment count since no compression of the end-flash gas is required. In contrast to the known systems, the boil-off gas system disclosed herein is minimally affected by the proposed liquefaction system. The disclosed aspects have the additional advantage that fuel gas used in the gas turbines will be from boil-off gas and/or feed gas. Both these fuel gas streams have a relatively lower nitrogen concentration than end flash gas which may make them more suitable as fuel gas for gas turbines.

In a disclosed aspect, a method includes receiving a first liquid nitrogen stream and a second liquid nitrogen stream produced at a location geographically separate from the LNG plant. A natural gas stream with a nitrogen concentration of greater than 1 mol % is liquefied by indirect exchange of heat with a cold nitrogen vent stream and the second liquid nitrogen stream to form a pressurized LNG stream, a first warm nitrogen vent stream, and a second warm nitrogen vent stream. The first warm nitrogen vent stream and second warm nitrogen vent stream may be released to the environment or may be directed to other parts of the facility for use. The pressurized LNG stream is directed to a jet pump where it is used as the motive fluid within the jet pump. A low pressure natural gas stream, such as boil off gas from either the LNG storage tanks and/or ship tanks, is directed to the jet pump where it is mixed with the pressurized LNG stream to form an LNG two phase stream. The LNG two phase stream may be directed to a separation vessel to form an LNG vapor stream and an LNG liquid stream. The LNG liquid stream is directed to one or more stages of a separation column. The LNG vapor stream is directed to the lower stages of the separation column. The first liquid nitrogen stream is directed to the top stage of the separation column. Within the separation column the first liquid nitrogen stream directly exchanges heat with the natural gas within the separation column resulting in the formation of an LNG stream as the liquid outlet from the separation column and the cold nitrogen vent stream as the vapor outlet from the separation column. The separation column may be a fractionation column, a distillation column, or an absorption column. The separation column may comprise five or more separation stages. The LNG stream may have a nitrogen molar concentration of less than 2 mol %, or more preferably, a nitrogen molar concentration of less than 1 mol %. The cold nitrogen vent stream may have a methane molar concentration of less than 1 mol %, or more preferably, a methane concentration of less than 0.1 mol %.

This proposed liquefaction system has the advantage of producing more LNG and requiring less equipment than the conventional design. The proposed liquefaction system has the additional benefit of reducing the liquid nitrogen flow to this separation column which reduces the size of the separation column.

In a disclosed aspect, a method includes receiving a liquid nitrogen stream produced at a location geographically separate from the LNG plant. A natural gas stream with a nitrogen concentration of greater than 1 mol % is liquefied by indirect exchange of heat with a cold nitrogen vent stream to form a pressurized LNG stream and a warm nitrogen vent stream. The warm nitrogen vent stream may be released to the environment or may be directed to other parts of the facility for use. The pressurized LNG stream is directed to a separation vessel to form an LNG vapor stream and an LNG liquid stream. The LNG liquid stream is expanded in an expansion device and then directed to one or more stages of a separation column. The expansion device may be an expansion valve, a liquid hydraulic turbine, or a combination thereof. The LNG vapor stream is directed to a jet pump where it is used as the motive fluid within the jet pump. A first low pressure natural gas stream, such as boil off gas from either the LNG storage tanks and/or ship tanks, is directed to the jet pump where it is mixed with the LNG vapor stream to form a second low pressure natural gas stream. The second low pressure natural gas stream is directed to the lower stages of the separation column. The liquid nitrogen stream is directed to the top stage of the separation column. Within the separation column the liquid nitrogen stream directly exchanges heat with the natural gas within the separation column resulting in the formation of an LNG stream as the liquid outlet from the separation column and the cold nitrogen vent stream as the vapor outlet from the separation column. The separation column may be a fractionation column, a distillation column, or an absorption column. The separation column may comprise five or more separation stages. The LNG stream may have a nitrogen molar concentration of less than 2 mol %, or more preferably, a nitrogen molar concentration of less than 1 mol %. The cold nitrogen vent stream may have a methane molar concentration of less than 1 mol %, or more preferably, a methane concentration of less than 0.1 mol %.

This proposed liquefaction system has the advantage of producing more LNG and requiring less equipment than the conventional design. The liquefaction system has the additional benefit of simplifying the design of the jet pump since there is no flashing of liquids within the jet pump. The heat exchanger design is also simplified since the there is a single cooling stream in the vapor phase.

Figure 3:
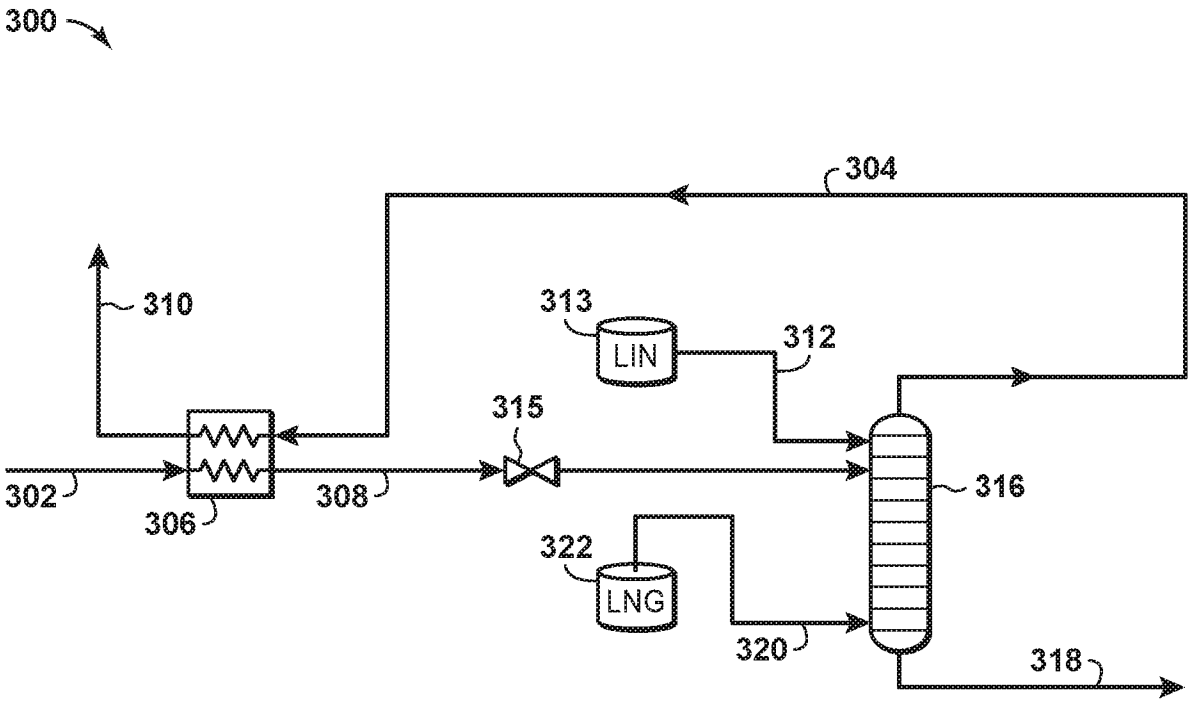
FIG. 3 is a schematic diagram of a liquefaction system according to disclosed aspects.

FIG. 3 is an illustration of a liquefaction system 300 according to an aspect of the disclosure. A natural gas stream 302 is at least partially liquefied by indirect exchange of heat with a cold nitrogen vent stream 304 in a heat exchanger 306 to form a pressurized LNG stream 308 and a warmed nitrogen vent stream 310. The warmed nitrogen vent stream 310 may be released to the environment or may be directed to other parts of the facility for use. A liquid nitrogen stream 312 is received from one or more LIN storage tanks 313. The liquid nitrogen stream 312 may be produced at a different geographic location from the LNG facility where liquefaction system 300 is located and transported to liquefaction facility 300 using known cryogenic transportation technologies. The pressurized LNG stream 308 is expanded in an expansion valve 315 and then directed to one or more stages of a separation column 316. The separation column 316 and all other separation columns disclosed herein may be a fractionation column, a distillation column, or an absorption column. The liquid nitrogen stream 312 is directed to the top stage of the separation column. Within the separation column the liquid nitrogen stream 312 directly exchanges heat with the natural gas within the separation column 316 resulting in the formation of an LNG stream 318 as the liquid outlet from the separation column 316 and the cold nitrogen vent stream 304 as the vapor outlet of the separation column 316. The LNG stream 318 may have a nitrogen molar concentration of less than 2 mol %, or more preferably, a nitrogen molar concentration of less than 1 mol %. The cold nitrogen vent stream 304 may have a methane molar concentration of less than 1 mol %, or more preferably, a methane concentration of less than 0.1 mol %. A low pressure natural gas stream 320 may optionally be directed to the lower stages of the separation column 316 to liquefy the hydrocarbons within the low pressure natural gas stream 320. Low pressure natural gas stream 320 may be characterized by its relative lower pressure than the pressure of the pressurized LNG stream 308. Low pressure natural gas stream 320 may comprise a boil-off gas from an LNG storage tank 322, which may be a land-based storage tank or part of a marine LNG transport vessel. The boil-off gas may be generated during storage, loading, and/or unloading of LNG into the LNG storage tank 322.

Figure 4:
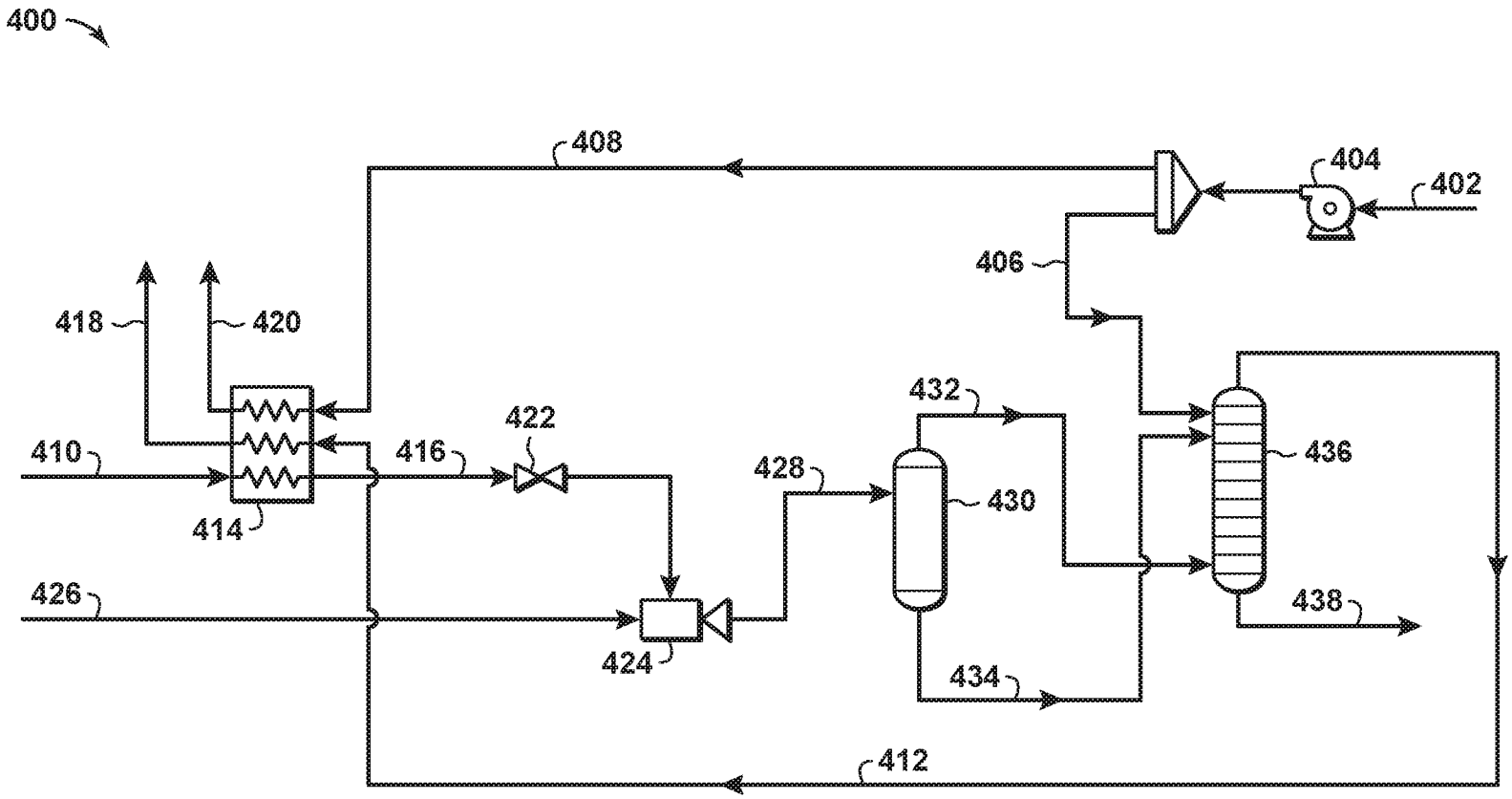
FIG. 4 is a schematic diagram of a liquefaction system according to disclosed aspects.

FIG. 4 is an illustration of a liquefaction system 400 according to another aspect of the disclosure. A liquid nitrogen (LIN) source stream 402 is produced at a location geographically separate from the liquefaction system 400 and transported to the location of the liquefaction system 400 using known cryogenic transportation technologies. The liquid nitrogen source stream 402 is pumped using a pump 404 and split into a first liquid nitrogen stream 406 and a second liquid nitrogen stream 408. A natural gas stream 410 is at least partially liquefied by indirect exchange of heat with a cold nitrogen vent stream 412 and the second liquid nitrogen stream 408 in a heat exchanger 414 to form a pressurized LNG stream 416, a first warm nitrogen vent stream 418, and a second warm nitrogen vent stream 420. The first warm nitrogen vent stream 418 and second warm nitrogen vent stream 420 may be released to the environment or may be directed to other parts of the facility for use. After being reduced in pressure by a valve 422 or other pressure reducing device, the pressurized LNG stream 416 is directed to a jet pump 424 where it is used as the motive fluid within the jet pump 424. A low pressure natural gas stream 426, such as boil off gas from either the LNG storage tanks and/or ship tanks, is directed to the jet pump 424 where it is mixed with the pressurized LNG stream 416 to form a two-phase LNG stream 428. The two-phase LNG stream 428 may be directed to a separation vessel 430 to form an LNG vapor stream 432 and an LNG liquid stream 434. The LNG liquid stream 434 is directed to one or more stages of a separation column 436. The LNG vapor stream 432 is directed to the lower stages of the separation column 436. The first liquid nitrogen stream 406 is directed to the top stage of the separation column 436. Within the separation column 436, the first liquid nitrogen stream 406 directly exchanges heat with the natural gas within the separation column 436, resulting in the formation of an LNG stream 438 as the liquid outlet from the separation column 436 and the cold nitrogen vent stream 412 as the vapor outlet from the separation column 436. The LNG stream 438 may have a nitrogen molar concentration of less than 2 mol %, or more preferably, a nitrogen molar concentration of less than 1 mol %. The cold nitrogen vent stream 412 may have a methane molar concentration of less than 1 mol %, or more preferably, a methane concentration of less than 0.1 mol %.

Low pressure natural gas stream 426 may be characterized by its relative lower pressure than the pressure of the pressurized LNG stream 416. Low pressure natural gas stream 426 may comprise a boil-off gas from an LNG storage tank similar to LNG storage tank 322, and which may be a land-based storage tank or part of a marine LNG transport vessel. The boil-off gas may be generated during storage, loading, and/or unloading of LNG into the LNG storage tank.

Figure 5:
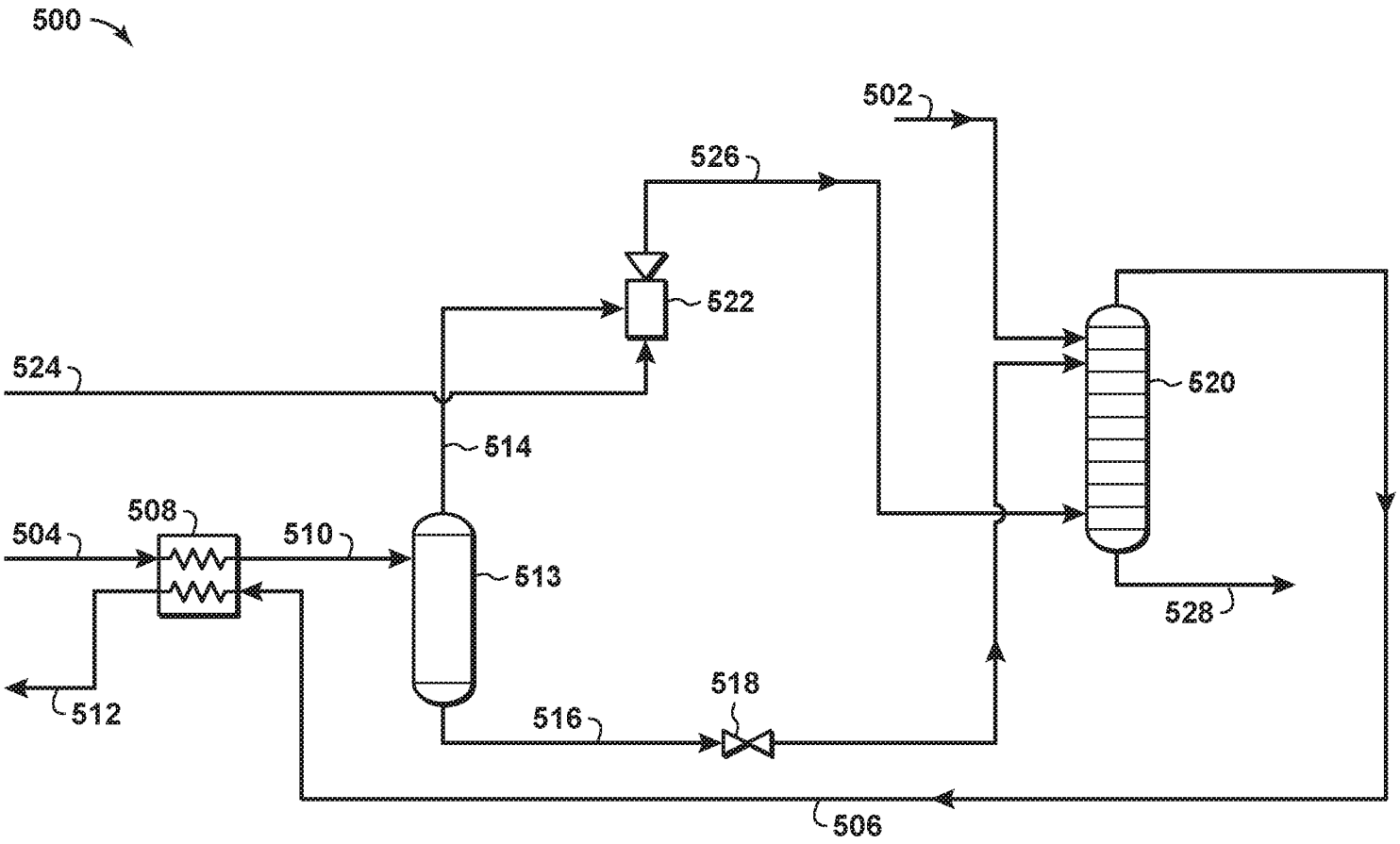
FIG. 5 is a schematic diagram of a liquefaction system according to disclosed aspects.

FIG. 5 is an illustration of a liquefaction system 500 according to another aspect. A liquid nitrogen stream 502 is produced at a location geographically separate from the LNG system and is transported to the location of the liquefaction system using known cryogenic transportation techniques. A natural gas stream 504 is at least partially liquefied by indirect exchange of heat with a cold nitrogen vent stream 506 in a heat exchanger 508 to form a pressurized LNG stream 510 and a warm nitrogen vent stream 512. The warm nitrogen vent stream 512 may be released to the environment or may be directed to other parts of the liquefaction system 500 or other facilities for use. The pressurized LNG stream 510 is directed to a separation vessel 513 to form an LNG vapor stream 514 and an LNG liquid stream 516. The LNG liquid stream 516 is expanded in an expansion valve 518 and then directed to one or more stages of a separation column 520. The LNG vapor stream 514 is directed to a jet pump 522 where it is used as the motive fluid within the jet pump 522. A first low pressure natural gas stream 524, such as boil off gas from either the LNG storage tanks and/or ship tanks, is directed to the jet pump 522 where it is mixed with the LNG vapor stream 514 to form a second low pressure natural gas stream 526. The second low pressure natural gas stream 526 is directed to the lower stages of the separation column 520. The liquid nitrogen stream 502 is directed to the top stage of the separation column 520. The liquid nitrogen stream 502 directly exchanges heat with the natural gas within the distillation column, resulting in the formation of an LNG stream 528 as the liquid outlet from the separation column 520 and the cold nitrogen vent stream 506 as the vapor outlet from the separation column 520. The LNG stream 528 may have a nitrogen molar concentration of less than 2 mol %, or more preferably, a nitrogen molar concentration of less than 1 mol %. The cold nitrogen vent stream 506 may have a methane molar concentration of less than 1 mol %, or more preferably, a methane concentration of less than 0.1 mol %.

Low pressure natural gas stream 524 may be characterized by its relative lower pressure than the pressure of the pressurized LNG stream 510. Low pressure natural gas stream 524 may comprise a boil-off gas from an LNG storage tank similar to LNG storage tank 322, and which may be a land-based storage tank or part of a marine LNG transport vessel. The boil-off gas may be generated during storage, loading, and/or unloading of LNG into the LNG storage tank.

Figure 6:
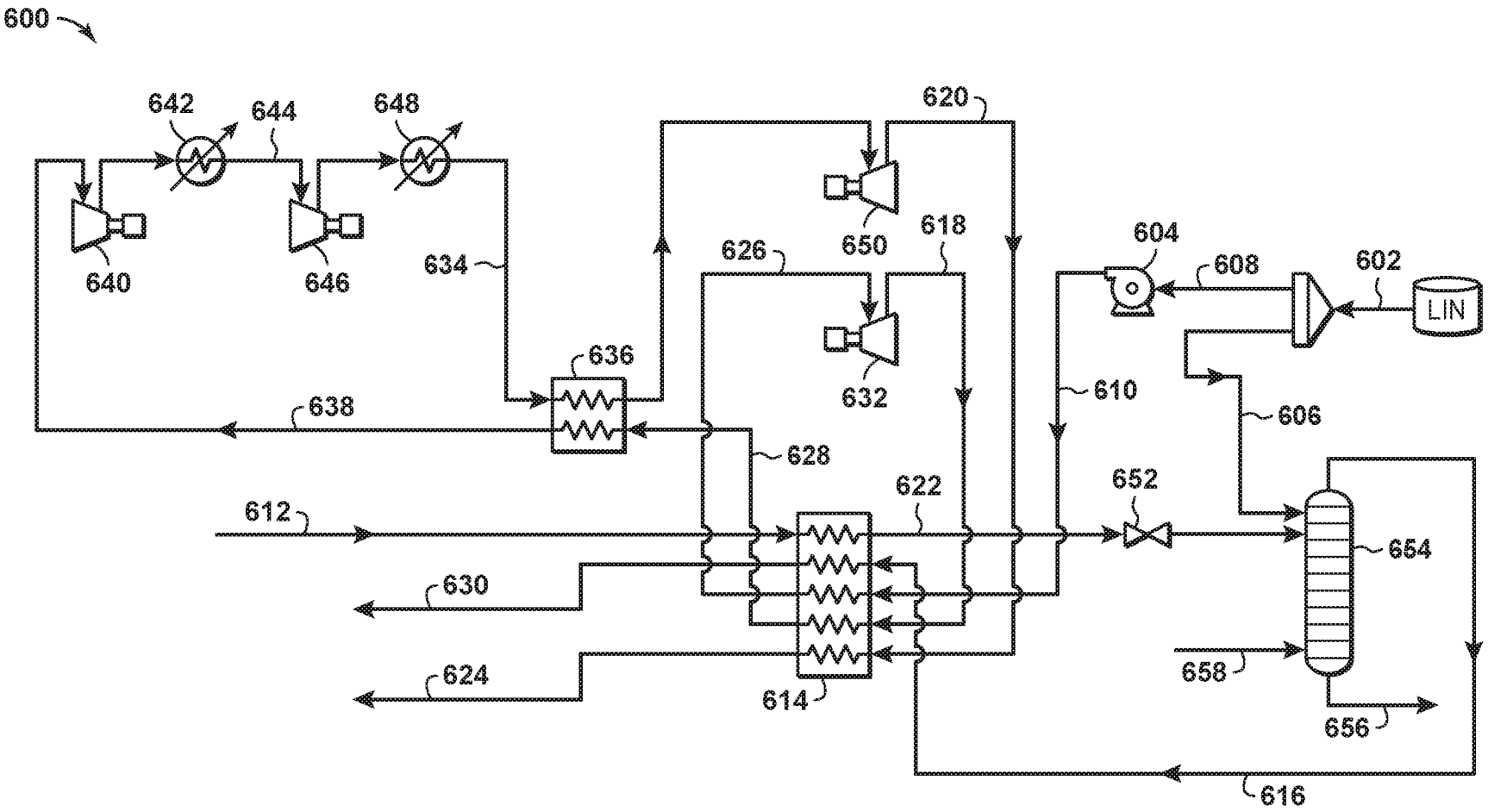
FIG. 6 is a schematic diagram of a liquefaction system according to disclosed aspects.

FIG. 6 is an illustration of a liquefaction system 600 according to still another aspect of the disclosure. A liquid nitrogen (LIN) source stream 602 is produced at a location geographically separate from the liquefaction system 600 and transported to the location of the liquefaction system 600 using known cryogenic transportation technologies. The liquid nitrogen source stream 602 is split into a first liquid nitrogen stream 606 and a second liquid nitrogen stream 608. The second liquid nitrogen stream 608 is pumped by a pump 604 to produce a pressurized liquid nitrogen stream 610. A natural gas stream 612 is at least partially liquefied by indirect exchange of heat, in a first heat exchanger 614, with a cold nitrogen vent stream 616, the pressurized liquid nitrogen stream 610, a first cold gas refrigerant stream 618, and a second cold gas refrigerant stream 620 to form a pressurized LNG stream 622, a first warm nitrogen vent stream 624, a first warm gas refrigerant stream 626, a second warm gas refrigerant stream 628, and a second warm nitrogen vent stream 630. The pressurized liquid nitrogen stream 610 may be produced by pumping the second liquid nitrogen stream 608 to a pressure greater than 200 psia. The first warm nitrogen vent stream 624 and the second warm nitrogen vent stream 630 may be released to the environment or may be directed to other parts of the facility for use. The first warm gas refrigerant stream 626 is expanded in a first expander 632 to produce the first cold gas refrigerant stream 618. The second warm gas refrigerant stream 628 exchanges heat with a second compressed refrigerant stream 634 in a second heat exchanger 636 to form a third warm gas refrigerant stream 638. The third warm gas refrigerant stream 638 is compressed in a first compressor 640 and then cooled in a first cooler 642 to form a first compressed refrigerant stream 644. The first compressed refrigerant stream 644 is compressed in a second compressor 646 and then cooled in a second cooler 648 to form the second compressed refrigerant stream 634. The second compressed refrigerant stream 634 is cooled further within the second heat exchanger 636 and then expanded in a second expander 650 to form the second cold gas refrigerant stream 620. The first compressor 640 may be mechanically coupled to the first expander 632. The second compressor 646 may be mechanically coupled to the second expander 650. The pressurized LNG stream 622 is expanded in an expansion valve 652 and then directed to one or more stages of a separation column 654. The first liquid nitrogen stream 606 is directed to the top stage of the separation column 654. Within the separation column 654, the first liquid nitrogen stream 606 directly exchanges heat with the natural gas within the separation column 654, resulting in the formation of an LNG stream 656 as the liquid outlet from the separation column 654 and the cold nitrogen vent stream 616 as the vapor outlet from the separation column 654. The LNG stream 656 may have a nitrogen molar concentration of less than 2 mol %, or more preferably, a nitrogen molar concentration of less than 1 mol %. The cold nitrogen vent stream 616 may have a methane molar concentration of less than 1 mol %, or more preferably, a methane molar concentration of less than 0.1 mol %. A low pressure natural gas stream 658, such as boil off gas from either the LNG storage tanks and/or ship tanks, may optionally be directed to the lower stages of the separation column 654 to liquefy the hydrocarbons within the low pressure natural gas stream 658. Low pressure natural gas stream 658 may be characterized by its relative lower pressure than the pressure of the pressurized LNG stream 622. Low pressure natural gas stream 658 may comprise a boil-off gas from an LNG storage tank similar to LNG storage tank 322, and which may be a land-based storage tank or part of a marine LNG transport vessel. The boil-off gas may be generated during storage, loading, and/or unloading of LNG into the LNG storage tank.

The jet pumps 424 and 522, which may also be termed eductors, use the high pressure of the pressurized LNG stream to increase the pressure of the lower pressure natural gas streams, which as previously described may comprise boil-off gas produced during storage, transport, loading, and/or offloading of LNG to or from stationary LNG tanks or LNG tanks onboard LNG transport vessels. Eductors may also be used in the aspects depicted in FIGS. 3 and 6 to use the higher pressure of the pressurized LNG streams 308, 622 to increase the pressure of the lower pressure natural gas streams 320, 658, respectively. The mixed outputs of these eductors may be sent directly to the columns 316, 654 as depicted in FIGS. 4 and 5.

Figure 7:
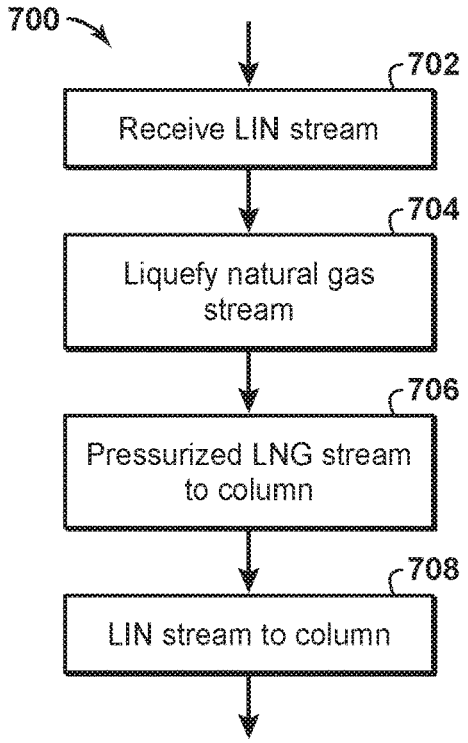
FIG. 7 is a flowchart showing a method according to disclosed aspects.

FIG. 7 is a flowchart of a method 700 for producing liquefied natural gas (LNG) from a natural gas stream having a nitrogen concentration of greater than 1 mol %, according to disclosed aspects. At block 702 at least one liquid nitrogen (LIN) stream is received at an LNG liquefaction facility. The at least one LIN stream may be produced at a different geographic location from the LNG liquefaction facility. At block 704 a natural gas stream is liquefied by indirect heat exchange with a nitrogen vent stream to form a pressurized LNG stream. The pressurized LNG stream has a nitrogen concentration of greater than 1 mol %. At block 706 the pressurized LNG stream is directed to one or more stages of a column to produce an LNG stream and the nitrogen vent stream, wherein the column has upper stages and lower stages. At block 708, one or more LIN streams is directed to one or more upper stages of the column.

Figure 8:
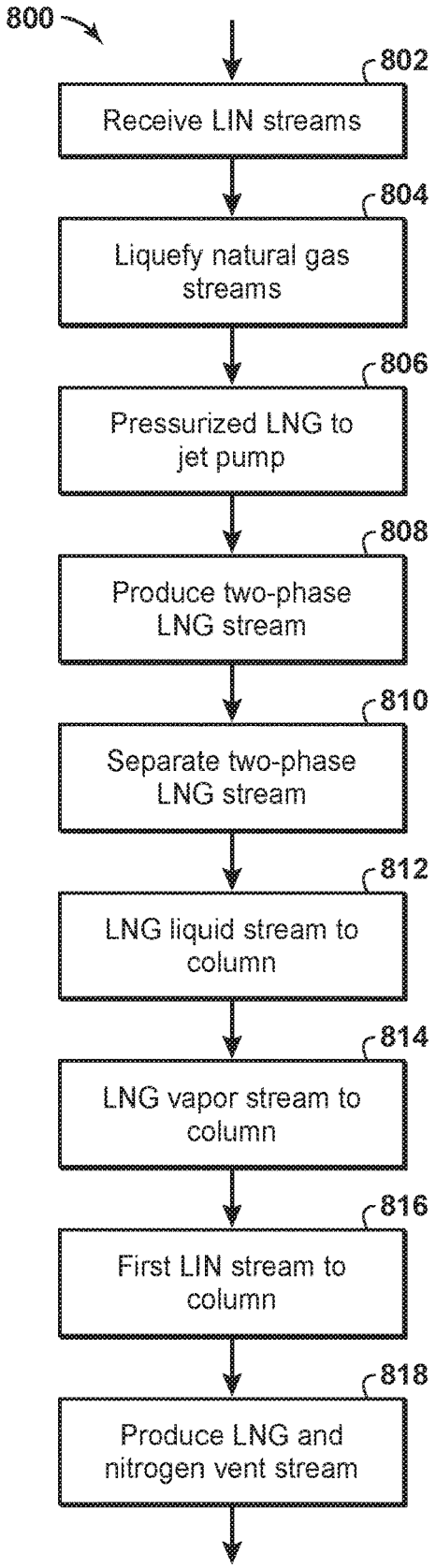
FIG. 8 is a flowchart showing a method according to disclosed aspects.

FIG. 8 is a flowchart of a method 800 for producing liquefied natural gas (LNG) from a natural gas stream having a nitrogen concentration of greater than 1 mol %, according to disclosed aspects. At block 802 a first liquefied nitrogen (LIN) stream and a second LIN stream are received at an LNG liquefaction facility. The first and second LIN streams may be produced at a different geographical location than the LNG liquefaction facility. At block 804 the natural gas stream is liquefied by indirect heat exchange with a nitrogen vent stream and the second liquefied nitrogen stream to form a pressurized LNG stream. The pressurized LNG stream has a nitrogen concentration of greater than 1 mol %. At block 806 the pressurized LNG stream is directed to a jet pump. The pressurized LNG stream is used as a motive fluid for the jet pump. At block 808 the pressurized LNG stream and a lower pressure natural gas stream are mixed in the jet pump to produce a two-phase LNG stream. The lower pressure natural gas stream has a pressure that is lower than a pressure of the pressurized LNG stream. At block 810 the two-phase LNG stream is separated into an LNG vapor stream and an LNG liquid stream. At block 812 the LNG liquid stream is directed to one or more stages of a column. At block 814 the LNG vapor stream is directed to one or more lower stages of the column. At block 816 the first liquefied nitrogen stream is directed to one or more upper stages of the column. At block 818 an LNG stream and the nitrogen vent stream are produced from the column.

Figure 9:
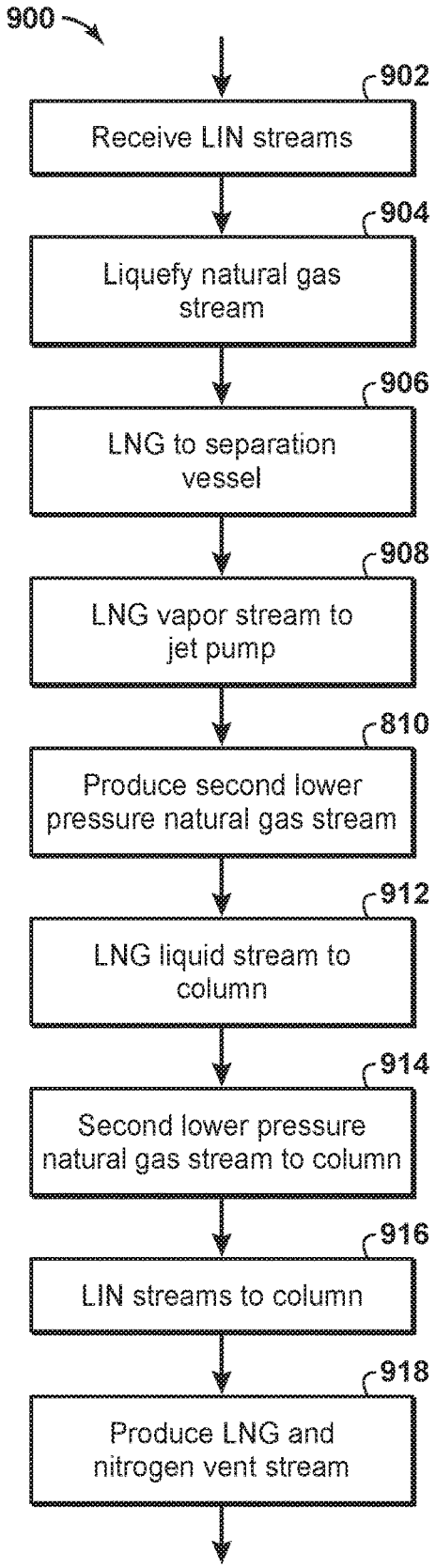
FIG. 9 is a flowchart showing a method according to disclosed aspects.

FIG. 9 is a flowchart of a method 900 for producing liquefied natural gas (LNG) from a natural gas stream having a nitrogen concentration of greater than 1 mol %, according to disclosed aspects. At block 902 one or more liquefied nitrogen (LIN) streams are received at an LNG liquefaction facility. The one or more LIN streams may be produced at a different geographical location than the LNG liquefaction facility. At block 904 the natural gas stream is at least partially liquefied by indirect heat exchange with a nitrogen vent stream and the second liquefied nitrogen stream to form a pressurized LNG stream. The pressurized LNG stream has a nitrogen concentration of greater than 1 mol %. At block 906 the pressurized LNG stream is directed to a separation vessel to produce an LNG vapor stream and an LNG liquid stream. At block 908 the LNG vapor stream is directed to a jet pump. The LNG vapor stream is used as a motive fluid for the jet pump. At block 910 the LNG vapor stream and a first lower pressure natural gas stream are mixed in the jet pump to produce a second lower pressure natural gas stream. Each of the first and second lower pressure natural gas streams have a pressure that is lower than a pressure of the pressurized LNG stream. At block 912 the LNG liquid stream is directed to one or more stages of a column. At block 914 the second lower pressure natural gas stream is directed to one or more lower stages of the column. At block 916 the one or more LIN streams are directed to one or more upper stages of the column. At block 918 an LNG stream and the nitrogen vent stream are produced from the column.

Figure 10:
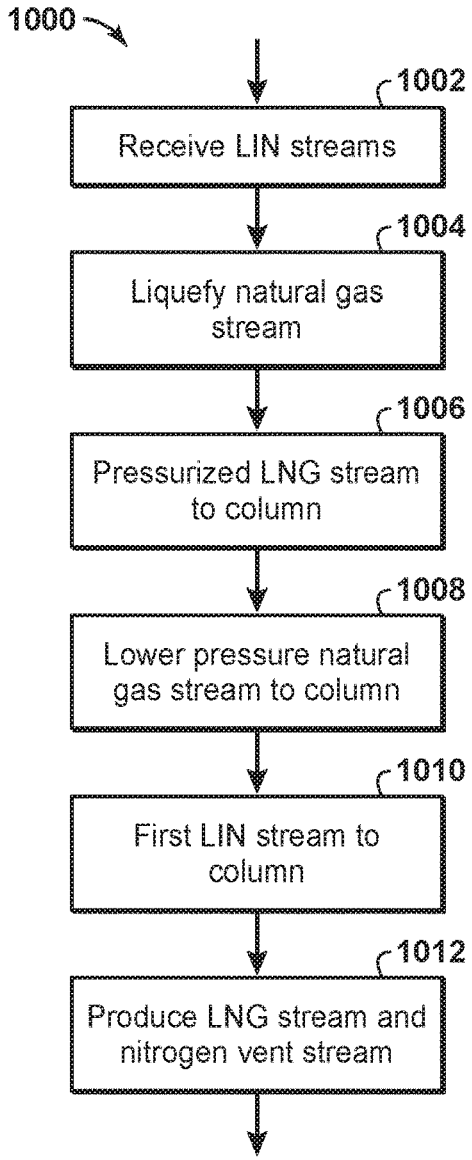
FIG. 10 is a flowchart showing a method according to disclosed aspects.

FIG. 10 is a flowchart of a method 1000 for producing liquefied natural gas (LNG) from a natural gas stream having a nitrogen concentration of greater than 1 mol %, according to disclosed aspects. At block 1002 a first liquefied nitrogen (LIN) stream and a second LIN stream are received at an LNG liquefaction facility. The first and second LIN streams may be produced at a different geographical location than the LNG liquefaction facility. At block 1004 the natural gas stream is liquefied by indirect heat exchange with a nitrogen vent stream and the second liquefied nitrogen stream to form a pressurized LNG stream, where the pressurized LNG stream has a nitrogen concentration of greater than 1 mol %. At block 1006 the pressurized LNG stream is directed to one or more stages of a column. At block 1008 a lower pressure natural gas stream is directed to one or more lower stages of the column. The lower pressure natural gas stream has a pressure that is lower than a pressure of the pressurized LNG stream. At block 1010 the first LIN stream is directed to one or more upper stages of the column. At block 1012 an LNG stream and the nitrogen vent stream are produced from the column.

Disclosed aspects may include any combinations of the methods and systems shown in the following numbered paragraphs. This is not to be considered a complete listing of all possible aspects, as any number of variations can be envisioned from the description above.

1. A method for producing liquefied natural gas (LNG) from a natural gas stream having a nitrogen concentration of greater than 1 mol %, comprising:

at an LNG liquefaction facility, receiving at least one liquid nitrogen (LIN) stream, the at least one LIN stream being produced at a different geographic location from the LNG liquefaction facility;

liquefying a natural gas stream by indirect heat exchange with a nitrogen vent stream to form a pressurized LNG stream, where the pressurized LNG stream has a nitrogen concentration of greater than 1 mol %;

directing the pressurized LNG stream to one or more stages of a column to produce an LNG stream and the nitrogen vent stream, wherein the column has upper stages and lower stages; and directing one or more LIN streams to one or more upper stages of the column.

2. The method of paragraph 1, further comprising:

prior to directing the pressurized LNG stream to one or more stages of the column, separating the pressurized LNG stream into an LNG vapor stream and an LNG liquid stream, where the LNG vapor stream has a nitrogen concentration greater than the nitrogen concentration of the pressurized LNG stream and the LNG liquid stream has a nitrogen concentration less than the nitrogen concentration of the pressurized LNG stream;

wherein directing the pressurized LNG stream to one or more stages of the column comprises directing the LNG liquid stream to one of the upper stages of the column; and directing the LNG vapor stream to one of the lower stages of the column.

3. The method of paragraphs 1 or 2, wherein the column is one of a fractionation column, a distillation column, or an absorption column.

4. The method of any one of paragraphs 1-3, wherein a natural gas stream is directed to one of the lower stages of the column, wherein the natural gas stream has a lower pressure than the pressurized LNG stream.

5. The method of paragraph 4, wherein the natural gas stream comprises boil-off gas from LNG storage tanks.

6. The method of paragraph 4, wherein the natural gas stream comprises boil-off gas from storage tanks on an LNG carrier ship.

7. The method of paragraph 4, further comprising compressing the natural gas stream prior to being directed to the column.

8. The method of any one of paragraphs 1-7, further comprising:

indirectly exchanging heat between the nitrogen vent stream and the natural gas stream to form a warmed nitrogen vent stream.

9. The method of any one of paragraphs 1-8, wherein the LNG stream has a nitrogen concentration of less than 1 mol %.

10. The method of any one of paragraphs 1-9, wherein the nitrogen vent stream has a methane concentration of less than 0.1 mol %.

11. The method of any one of paragraphs 1-10, further comprising:

expanding the pressurized LNG stream within a liquid hydraulic turbine prior to being directed to the column.

12. A method for producing liquefied natural gas (LNG) from a natural gas stream having a nitrogen concentration of greater than 1 mol %, where the method comprises:

at an LNG liquefaction facility, receiving a first liquefied nitrogen (LIN) stream and a second LIN stream, the first and second LIN streams being produced at a different geographical location than the LNG liquefaction facility;

liquefying the natural gas stream by indirect heat exchange with a nitrogen vent stream and the second liquefied nitrogen stream to form a pressurized LNG stream, where the pressurized LNG stream has a nitrogen concentration of greater than 1 mol %;

directing the pressurized LNG stream to a jet pump, and using the pressurized LNG stream as a motive fluid for the jet pump;

mixing the pressurized LNG stream and a lower pressure natural gas stream in the jet pump to produce a two-phase LNG stream, wherein the lower pressure natural gas stream has a pressure that is lower than a pressure of the pressurized LNG stream;

separating the two-phase LNG stream into an LNG vapor stream and an LNG liquid stream;

directing the LNG liquid stream to one or more stages of a column;

directing the LNG vapor stream to one or more lower stages of the column;

directing the first liquefied nitrogen stream to one or more upper stages of the column; and producing an LNG stream and the nitrogen vent stream from the column.

13. The method of paragraph 12, wherein the column is one of a fractionation column, a distillation column, or an absorption column.

14. The method of paragraph 12 or paragraph 13, wherein the lower pressure natural gas stream comprises boil-off gas extracted from LNG storage tanks.

15. The method of paragraph 12 or paragraph 13, wherein the lower pressure natural gas stream comprises boil-off gas extracted from LNG during storage or unloading operations from an LNG carrier ship.

16. The method of any one of paragraphs 12-15, further comprising compressing the lower pressure natural gas stream prior to being directed to the column.

17. The method of any one of paragraphs 12-16, further comprising:

indirectly exchanging heat between the nitrogen vent stream and the natural gas stream to form a warmed nitrogen vent stream.

18. The method of any one of paragraphs 12-17, wherein the LNG stream has a nitrogen molar concentration of less than 1 mol %.

19. The method of any one of paragraphs 12-18, wherein the nitrogen vent stream has a methane molar concentration of less than 0.1 mol %.

20. A method for producing liquefied natural gas (LNG) from a natural gas stream having a nitrogen concentration of greater than 1 mol %, where the method comprises:

at an LNG liquefaction facility, receiving one or more liquefied nitrogen (LIN) streams, the one or more LIN streams being produced at a different geographical location than the LNG liquefaction facility;

at least partially liquefying the natural gas stream by indirect heat exchange with a nitrogen vent stream and the second liquefied nitrogen stream to form a pressurized LNG stream, where the pressurized LNG stream has a nitrogen concentration of greater than 1 mol %;

directing the pressurized LNG stream to a separation vessel to produce an LNG vapor stream and an LNG liquid stream;

directing the LNG vapor stream to a jet pump, and using the LNG vapor stream as a motive fluid for the jet pump;

mixing the LNG vapor stream and a first lower pressure natural gas stream in the jet pump to produce a second lower pressure gas stream, wherein each of the first and second lower pressure natural gas streams have a pressure that is lower than a pressure of the pressurized LNG stream;

directing the LNG liquid stream to one or more stages of a column;

directing the second lower pressure natural gas stream to one or more lower stages of the column;

directing the one or more LIN streams to one or more upper stages of the column; and producing an LNG stream and the nitrogen vent stream from the column.

21. The method of paragraph 20, wherein the LNG stream has a nitrogen molar concentration of less than 1 mol %.

22. The method of paragraph 20 or paragraph 21, wherein the nitrogen vent stream has a methane molar concentration of less than 0.1 mol %.

23. The method of any one of paragraphs 20-22, wherein the column is one of a fractionation column, a distillation column, or an absorption column.

24. The method of any one of paragraphs 20-23, wherein the lower pressure natural gas stream comprises boil-off gas extracted from LNG storage tanks.

25. The method of any one of paragraphs 20-24, wherein the lower pressure natural gas stream comprises boil-off gas extracted from LNG during storage or unloading operations from an LNG carrier ship.

26. A method for producing liquefied natural gas (LNG) from a natural gas stream having a nitrogen concentration of greater than 1 mol %, where the method comprises:

at an LNG liquefaction facility, receiving a first liquefied nitrogen (LIN) stream and a second LIN stream, the first and second LIN streams being produced at a different geographical location than the LNG liquefaction facility;

liquefying the natural gas stream by indirect heat exchange with a nitrogen vent stream and the second liquefied nitrogen stream to form a pressurized LNG stream, where the pressurized LNG stream has a nitrogen concentration of greater than 1 mol %;

directing the pressurized LNG stream to one or more stages of a column;

directing a lower pressure natural gas stream to one or more lower stages of the column, wherein the lower pressure natural gas stream has a pressure that is lower than a pressure of the pressurized LNG stream;

directing the first liquefied nitrogen stream to one or more upper stages of the column; and producing an LNG stream and the nitrogen vent stream from the column.

27. The method of paragraph 26, wherein liquefying the natural gas stream by indirect heat exchange with a nitrogen vent stream and the second liquefied nitrogen stream is accomplished in a heat exchanger, the method further comprising:

forming a first warm gas refrigerant stream from the second liquid nitrogen stream after the second liquid nitrogen stream passes through the heat exchanger;

expanding the first warm gas refrigerant stream to form a first cold gas refrigerant stream; and directing the first cold gas refrigerant stream through the heat exchanger to liquefy the natural gas stream.

28. The method of paragraph 27, further comprising:

forming a second warm gas refrigerant stream from the first cold gas refrigerant stream after the first cold gas refrigerant stream passes through the heat exchanger;

compressing and cooling the second warm gas refrigerant stream to form a compressed refrigerant stream;

in a second heat exchanger, exchanging heat between the second warm gas refrigerant stream and the compressed refrigerant stream;

expanding the compressed refrigerant stream to form a second cold gas refrigerant stream; and directing the second cold gas refrigerant stream through the heat exchanger to liquefy the natural gas stream.

29. The method of any one of paragraphs 26-28, wherein the LNG stream has a nitrogen molar concentration of less than 1 mol %.

30. The method of any one of paragraphs 26-29, wherein the nitrogen vent stream has a methane molar concentration of less than 0.1 mol %.

31. The method of any one of paragraphs 26-30, wherein the column is one of a fractionation column, a distillation column, or an absorption column.

32. The method of any one of paragraphs 26-31, wherein the lower pressure natural gas stream comprises boil-off gas extracted from LNG storage tanks.

33. The method of any one of paragraphs 26-31, wherein the lower pressure natural gas stream comprises boil-off gas extracted from LNG during storage or unloading operations from an LNG carrier ship.

It should be understood that the numerous changes, modifications, and alternatives to the preceding disclosure can be made without departing from the scope of the disclosure. The preceding description, therefore, is not meant to limit the scope of the disclosure. Rather, the scope of the disclosure is to be determined only by the appended claims and their equivalents. It is also contemplated that structures and features in the present examples can be altered, rearranged, substituted, deleted, duplicated, combined, or added to each other.

What is claimed is:

1. A method for producing liquefied natural gas (LNG) from a natural gas stream having a nitrogen concentration of greater than 1 mol %, where the method comprises:

at an LNG liquefaction facility, receiving a first liquefied nitrogen (LIN) stream and a second LIN stream, the first and second LIN streams being produced at a different geographical location than the LNG liquefaction facility;

liquefying the natural gas stream by indirect heat exchange with a nitrogen vent stream and the second liquefied nitrogen stream to form a pressurized LNG stream, where the pressurized LNG stream has a nitrogen concentration of greater than 1 mol %;

directing the pressurized LNG stream to a jet pump, and using the pressurized LNG stream as a motive fluid for the jet pump;

mixing the pressurized LNG stream and a lower pressure natural gas stream in the jet pump to produce a two-phase LNG stream, wherein the lower pressure natural gas stream has a pressure that is lower than a pressure of the pressurized LNG stream;

separating the two-phase LNG stream into an LNG vapor stream and an LNG liquid stream;

directing the LNG liquid stream to one or more stages of a column, wherein the column is one of a fractionation column, a distillation column, or an absorption column;

directing the LNG vapor stream to one or more lower stages of the column;

directing the first liquefied nitrogen stream to one or more upper stages of the column; and producing an LNG stream and the nitrogen vent stream from the column.

2. The method of claim 1, wherein the lower pressure natural gas stream comprises one of boil-off gas extracted from LNG storage tanks, or boil-off gas extracted from LNG during storage or unloading operations from an LNG carrier ship.

3. The method of claim 1, further comprising compressing the lower pressure natural gas stream prior to being directed to the column.

4. The method of claim 1, further comprising:

indirectly exchanging heat between the nitrogen vent stream and the natural gas stream to form a warmed nitrogen vent stream.

5. The method of claim 1, wherein the LNG stream has a nitrogen molar concentration of less than 1 mol %.

6. A method for producing liquefied natural gas (LNG) from a natural gas stream having a nitrogen concentration of greater than 1 mol %, where the method comprises:

at an LNG liquefaction facility, receiving one or more liquefied nitrogen (LIN) streams, the one or more LIN streams being produced at a different geographical location than the LNG liquefaction facility;

at least partially liquefying the natural gas stream by indirect heat exchange with a nitrogen vent stream to form a pressurized LNG stream, where the pressurized LNG stream has a nitrogen concentration of greater than 1 mol %;

directing the pressurized LNG stream to a separation vessel to produce an LNG vapor stream and an LNG liquid stream;

directing the LNG vapor stream to a jet pump, and using the LNG vapor stream as a motive fluid for the jet pump;

mixing the LNG vapor stream and a first lower pressure natural gas stream in the jet pump to produce a second lower pressure gas stream, wherein each of the first and second lower pressure natural gas streams have a pressure that is lower than a pressure of the pressurized LNG stream;

directing the LNG liquid stream to one or more stages of a column;

directing the second lower pressure natural gas stream to one or more lower stages of the column;

directing the one or more LIN streams to one or more upper stages of the column; and producing an LNG stream and the nitrogen vent stream from the column.

7. The method of claim 6, wherein the lower pressure natural gas stream comprises one of boil-off gas extracted from LNG storage tanks, or boil-off gas extracted from LNG during storage or unloading operations from an LNG carrier ship.

* * * * *